United States Patent [19]

Panetti

[11] 4,416,091

[45] Nov. 22, 1983

[54] GRINDING DEVICE FOR THE CONTINUOUS AND IN SITU REPROFILING OF A RAILROAD TRACK

[75] Inventor: Romolo Panetti, Geneva, Switzerland

[73] Assignee: Speno International S.A., Geneva, Switzerland

[21] Appl. No.: 213,073

[22] Filed: Dec. 4, 1980

[30] Foreign Application Priority Data

Dec. 31, 1979 [CH] Switzerland ..... 11502/79

[51] Int. Cl.[3] ..... B24B 23/00

[52] U.S. Cl. ..... 51/178; 51/325

[58] Field of Search ..... 51/178, 241 LG, 325

[56] References Cited

U.S. PATENT DOCUMENTS 2,132,470 10/1938 Hobson et al. ..... 51/178

FOREIGN PATENT DOCUMENTS 432263 7/1926 Fed. Rep. of Germany ..... 51/178
480307 7/1932 Fed. Rep. of Germany ..... 51/178
2381132 10/1978 France ..... 51/178
52659 8/1910 Switzerland .
606616 11/1978 Switzerland .
702093 12/1979 U.S.S.R. ..... 51/178

*Primary Examiner*—Roscoe V. Parker
*Attorney, Agent, or Firm*—Young & Thompson

[57] ABSTRACT

Device intended to be displaced along track rails and comprising a frame (2) guided by the rail (1) provided with a grinding wheel (6) which grinds through its periphery. To uniformly distribute the wear resulting from contact with the rail on all its active surface, the grinding wheel (6) is driven, in addition to the continuous rotation supplied by a driving motor (7), in an alternating motion transverse to the track by means of an actuating mechanism. This actuating mechanism comprises a motor-gear assembly (13) driving an eccentric shaft (9) on the eccentric of which the movable support (8) is hinged. To avoid the formation of sinusoidal traces due to the grinding, the amplitude a of the reciprocal movement is related by the equation $a \cong l - f$ to the width l of the active surface of the grinding wheel and to the width f of the portion of the profile of the rail which is ground.

7 Claims, 11 Drawing Figures

GRINDING DEVICE FOR THE CONTINUOUS AND IN SITU REPROFILING OF A RAILROAD TRACK

The present invention has for its object a grinding device for continuous and in situ reprofiling of a railroad track.

The circulation of trains at high travelling speeds in conjunction with the transverse inclination of the track cause serious deformations to occur on railway track rails, in addition to those due to their undulatory wearing, particularly in the curves of the inside rail. Under the hammering action and axial thrust of train wheels the rolling table flattens, sometimes to the extent that it assumes a concave shape as opposed to its original convex shape, and the metal forms lateral burrs which alter the side and the vertical face of the head of the rail.

These deformations cause transverse accelerations and serpentine movements of the trains, which adversely affect the rolling material and which further deform the rail itself.

Problems inherent to the driving modes and the positioning of the grinding wheels of known reprofiling machines have in the past made these aleatory deformations difficult to correct.

When a grinding wheel working with its periphery is placed parallel to the rail, its active surface, while correcting the deformation, progressively wears to the shape of the deformed rail. Thus it then tends to reproduce this deformation on a section of rail which was not originally deformed. For example on a rolling table of an inside rail of a curve whose profile is deformed as to approach concavity, a shaped grinding wheel will flatten and may eventually become convex. At the end of a curve, where the rail is less deformed and has partially retained its original convex shape, the grinding wheels will have the tendency to flatten the head of the rail, which is not the intended result. Similarly during the grinding of heavy burrs, these burrs will dig a groove into the grinding wheel which afterwards will leave prints on the rail corresponding to the edges of this groove.

The deformation of the active surface of the grinding wheel caused by these phenomena causes its rapid wear and necessitates its frequent replacement despite the fact that the volume of abrasive material present on the wheel is only slightly reduced.

A proposed solution is described in Swiss Pat. No. 52.659 published in 1910. This solution consists of placing a cylindrical grinding wheel, having a width less than the width of the surface to be ground, in a reciprocating transverse movement with respect to the rail during its advance along said rail, so as to ensure uniform wear of the periphery of the grinding wheel. In this device the tracking of the grinding wheel is accomplished by placing parallel to the rail a grinding wheel rotatably mounted to a carrier which is in turn adjustably mounted lengthwise between the two axles of a lorry which stands still with respect to the rail during the grinding operation. When a portion of the rail is thus ground, the grinding is stopped and the lorry is moved along the track to a new portion of rail equal in length to the parallel displacement of the grinding wheel carrier. A new portion of the rail is then ground, the lorry again being maintained in a fixed position. This technique is no longer used since it presents the drawbacks of leaving a sinusoidal trace on the rail which sinusoid is defined by the two edges of the grinding wheel during its forward motion, and of creating discontinuities between each successive portion of rail thus ground. These grinding traces and discontinuities between the ground portions are even less tolerable with the greater speed of travel of modern trains. Finally, as described in this patent, this grinding device does not permit restoration of the curved profile of the rails; it permits only a planar grinding of the rolling surface of the rail.

Now, the grinding of the rails must not only reprofile the rails but must also be done in a continuous manner to avoid discontinuities and above all to permit maintenance of the track in a manner efficient enough to allow the unhindered operation of a modern railway.

Two recent solutions have been proposed in which the grinding wheel is placed parallel to the rail by means of continuous tracking, without any reciprocating transverse movement.

The first solution teaches to add to the grinding device a reprofiling device which periodically restores the active surface of the grinding wheel by means of diamond tools. This solution is interesting when using shaped grinding wheels the active surface of which presents a transverse cross section having the original curvature of a portion of the profile of the head of the rail, but it necessitates frequent checks of the work done to determine the need for reprofiling the wheel, and the installation of such devices is expensive. Furthermore, the overall reduction in size of the grinding wheel is substantial.

The second solution, which avoids the deformation of the active surface of the grinding wheels and its consequences, teaches to employ flat lapidary grinding wheels, working on their face and not on their periphery; but, the space occupied by these lapidary grinding wheels causes problems when the rail to be ground is surrounded by obstacles such as crossings and counterrails.

The device according to the invention offers a solution which avoids the above mentioned drawbacks. It permits the use of peripherical active surface grinding wheels, having a small size, a high cutting speed, and which are tracked into the material creating working strokes of a great depth, without, however, necessitating the addition of a reprofiling device; the reciprocating movement given to the grinding wheel uniformly distributes wear on the whole of its active surface without leaving any sinusoidal traces inherent to the combination of tracking and reciprocatory movements of the grinding wheel. This latter advantage is due to the fact that the amplitude a of the reciprocating movement is approximately equal to the width of the grinding wheel minus the width of the portion of the profile of the head of the rail ground so that the edges of the grinding wheel do not cross this portion during the reciprocating movement.

The attached drawings show by way of example one embodiment of the object of the invention, as well as seven variants of structural details.

Figure 9:
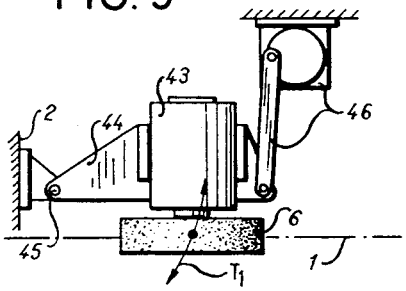

FIGS. 9 an 10 are top views, schematic and partial, of the fifth and sixth variants.

Figure 11:
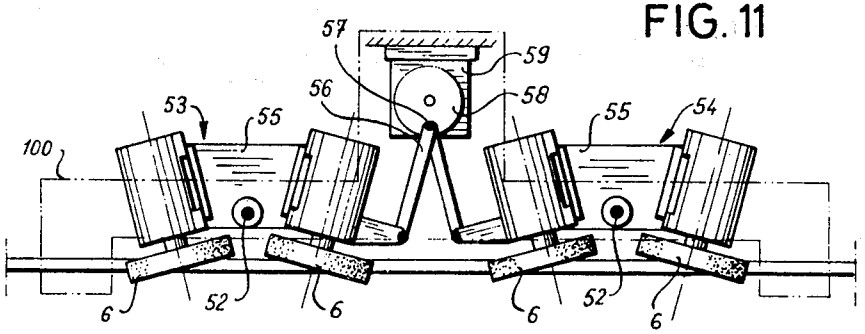

FIG. 11 is a schematic plan view of the seventh variant.

Figure 1:
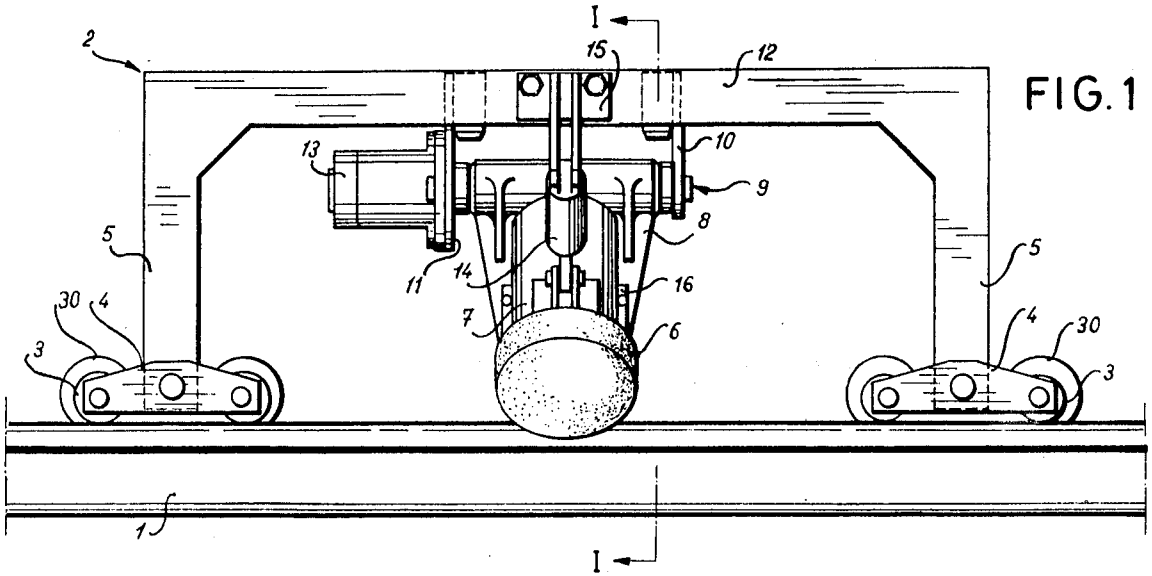
FIG. 1 is a side view of the main embodiment.
Figure 2:
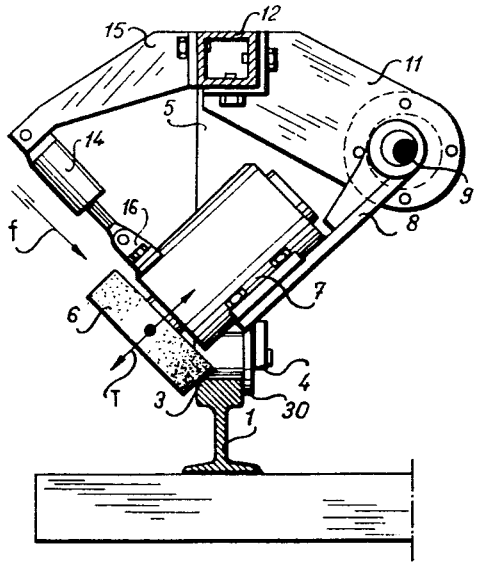
FIG. 2 is a cross-section along line I—I of FIG. 1.

The device shown in FIGS. 1 and 2 is adapted to correct the burrs which deform the profile of the side of the head of the rail 1.

This device comprises a frame 2 having a bridge shape resting on the rail 1 by two pairs of rollers 3 each roller having end flanges 30. Each pair of rollers 3 is mounted on a double swinging bar 4 hinged to a leg 5 of the said frame.

A cylindrical grinding wheel 6 having rectilinear side lines is rotated by a motor 7 fixed onto a support 8. This support 8 is pivoted on an exentric shaft 9 itself pivoted in two brackets 10 and 11 fastened to the beam 12 of the frame 2.

A motor gear assembly 13 for driving the eccentric shaft 9 is fastened on the bracket 11.

A double acting hydraulic jack 14 is hinged by its cylinder end to a bracket 15, fixed to the beam 12 of the frame 2, and by the rod of its piston to a bracket 16 fixed to the motor 7, which drives the grinding wheel 6.

In this construction, the frame 2 is intended to be connected in the usual way to a railway vehicle and placed along a railroad track to be ground. Means are provided to vertically and laterally urge this frame 2 against one rail of the track at a given pressure.

The working surface of the cylindrical grinding wheel 6 is its periphery. The axis of rotation of the wheel is orientated parallel to a tangent to the profile of the head of the rail, which tangent is chosen in relation to the deformation to be corrected, here the tangent is inclined with respect to the portion of the shape of the outside side of the head of the rail where the burr is formed.

The movable support 8 on which the grinding wheel 6 and its driving motor 7 are fixed is hinged on the eccentric shaft 9 such that the reciprocating movement created is transverse to the rail 1. The axis of rotation of the grinding wheel is perpendicular to the rail and the eccentric shaft 9 parallel to the rail.

The hydraulic jack controls the grinding pressure while the rail itself guides the reciprocating movement of the grinding wheel 6. The jack 14 is connected to a feeding circuit controlled by a given pressure which is pre-established as a function of the deepness of the working stroke desired, which stroke is in turn a function of the amplitude of the deformation to be corrected.

One example of such a circuit, described in Swiss Pat. No. 606,616, comprises a pressure control-valve located between a fluid feeding pump under pressure and one of the two chambers of the hydraulic. suspension jack of the grinding wheel, here the hydraulic jack 14. The control member of this valve is controlled by the operator of the device, for example based on the display of a pre-established value of the deepness desired for the working stroke.

Figure 3:
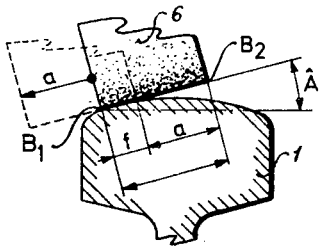
FIGS. 3 and 4 are schemes showing the principle of the invention.
Figure 4:
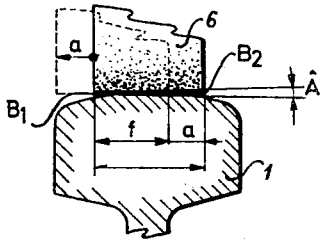

To avoid sinusoidal traces on the rail which could be formed by the attack of the edges $B_1$ and $B_2$ of the grinding wheel 6 during its combined tracking and reciprocating movements, the amplitude a of the reciprocating movement is approximately equal to a pre-established value which is a function on the one hand of the width of the grinding wheel used and on the other hand of the width of the portion of the profile of the head of the rail ground, according to a relation $a \cong l - f$ shown by FIGS. 3 and 4.

According to the orientation A of the grinding wheel 6 about the head of the rail 1 and according to the deepness of the working stroke, chosen as a function of the severity of the deformation to be eliminated, a part of the width f is ground.

These values being known for each orientation A of the grinding wheel, and the width 1 of this latter being given, one sees (FIGS. 3 and 4) that by using the above named relation $a \cong l - f$ the edges $B_1$ and $B_2$ of the grinding wheel 6 which could leave a grinding trace, practically never penetrate into the ground portion having the width f of the head of the rail. One sees also that in such a way, the amplitude a of the reciprocating movement of the grinding wheel ensures contact by the whole width l of the grinding wheel with the ground portion f. Due to these two effects, one ensures simultaneously both the permanent auto-reprofiling of the active surface of the grinding wheel by means of the uniform regrinding of its deformations, and avoids the formation of sinusoidal grinding traces on the width f of the ground portion of the head of the rail. Of course, when the grinding wheel 6 is in an inclined position with respect to the length of the rail, as described later on in variants, the values a and f of the relation $a \cong l - f$ are those of the projections of the amplitude of the reciprocal movement and of the width in a plane perpendicular to the rail.

The device described combines the advantages of the permanent autoprofiling of the rail and the avoidance of the formation of grooves in the rail thus saving time and material.

Furthermore, by providing several grinding wheels at different angles A on the same frame, it is possible to reconstituate a polygonal profile similar to the original curved profile of the rail in the same way as lapidary wheels which are used on their periphery.

Figure 5:
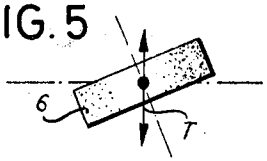
FIGS. 5 and 6 are schematic and partial views of the first two variants in the direction of the arrow f of FIG. 2.
Figure 6:
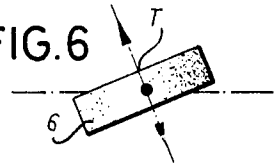

In the variant shown in FIGS. 5 and 6, the grinding wheel 6, viewed from arrow f of FIG. 2, is located obliquely with respect to the rail. In this case, the reciprocal movement, shown by the arrow T, is made either in the direction of the axis of rotation of the grinding wheel (FIG. 6), or obliquely with respect to the said axis of rotation (FIG. 5). The position of the motor 7 on the movable support 8 and the orientation in the space of the exentric shaft 9 depend of course on the orientation given to the grinding wheel 6.

The grinding motor 7 of the grinding wheel 6 may be independent from the movable support 8 and from the grinding wheel 6 connected to it through a transmission.

Figure 7:
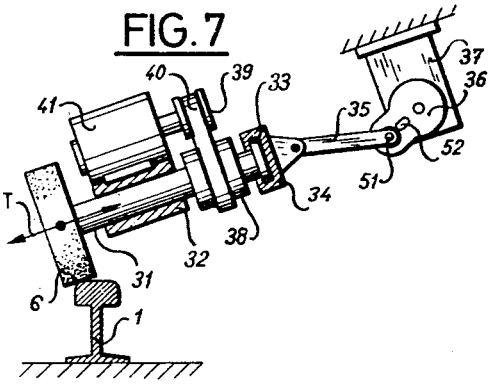
FIGS. 7 and 8 are side views, partial and schematic, of the third and fourth variants.

In a third variant shown in FIG. 7, the reciprocal movement is obtained by a translation. Therefore, the grinding wheel 6 is mounted on a shaft 31 guided in a bearing 32 carried by an arm, not shown, hinged to the frame 2.

The free end of the shaft 31 is provided with an annular shoulder 33 rotatably mounted in a thrust bearing 34 to which it is axially fastened. This thrust bearing 34 is connected by means of lever 35 to a crank pin 51 of a crank shaft 36 rotated by a motor gear assembly 37. The shaft 31 is rotated by means of a transmission having pulleys 38, 39 and a belt 40, which transmit power from a motor 41 fixed on the bearing 32. In this third variant, the crank pin 51 is fixed in a radial slot 52 of the plate of the crank shaft 36. The position of the crank pin 51 in the slot 52 is adjustable, permitting adjustment of the amplitude a of the reciprocal movement of the grinding wheel 6 which in turn permits, if necessary, variation of the width f of the portion ground of the head of the rail, according to the formula $A \cong l - f$ already explained. This adjustment is realized by modifying the radial distance between the crank pin 51 and the axis of rotation of the crank shaft 36 by a displacement of the said crank pin along the slot 52.

In the mechanism using an eccentric, such as the one shown in the first example (FIGS. 1 and 2) one changes the eccentricity of the shaft 9 to adjust the value of the amplitude a.

Figure 8:
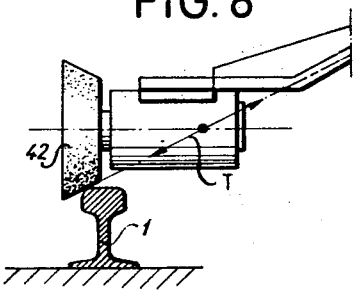

In a variant shown in FIG. 8, the grinding wheel 42 is frustoconical and the reciprocal movement is directed in a direction near the one of the side lines of the frustoconical grinding wheel coming into contact with the rail.

In a fifth variant shown at FIG. 9, the motor 43 of the grinding wheel 6 is mounted on a support 44 pivoting around a fixed axis 45 tiltably displaceable in a plane transverse to the rail 1, which axis is fast to the frame 2. The opposite end of the support 44 is driven in an alternating movement of a pendular type by a crank and lever driving connection 46 according to a trajectory along an arc $T_1$. This trajectory $T_1$ is approximately transverse to the rail 1 and has at its center the axis 45 of the support 44.

Figure 10:
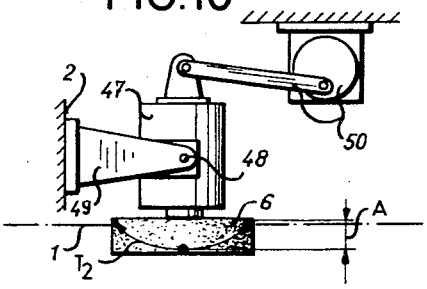

In a sixth embodiment shown in FIG. 10, the motor 47 of the grinding wheel 6 is mounted pivotally about a fixed axis 48 positioned laterally in a plane transverse to the rail 1 which axis is carried by a bracket 49 fast with the frame 2. The motor 47 of the grinding wheel is rotated about its axis 48 in an alternating pendular motion by a crank shaft 50 according to a trajectory $T_2$ having the shape of an arc, oriented approximately in the direction of the rail 1 and having for its center the pivoting axis 48 of the motor 47. In this variant, the lever arms of the movable elements are designed such that the projection A of the trajectory $T_2$ in a plane perpendicular to the extension of the rail 1 is equal to the value a defined by the relation $a \cong l - f$.

Finally, in a last variant shown in FIG. 11 several grinding wheels 6, forming two groups 53 and 54 of two grinding wheels each, are mounted on the same frame 100, shown in broken lines so as not to crowd the drawing.

In each group 53 and 54 the two grinding wheels 6 are mounted according to the principle of the variant shown in FIG. 9, that is to say pivotably about a shaft 52, but oriented obliquely with respect to the length of the rails 1.

The motors and the grinding wheels of each group are fastened to a common frame 55 pivotally mounted and sliding within the previously mentioned limits on one of the two shafts 52. These two shafts 52 are rigidly fixed to the frame 100 and each of the two housings 55 is connected to the frame by means of a jack (not shown) for regulating the grinding depth, of the type already described in the first embodiment shown in FIGS. 1 and 2. Each beam 55 is connected by a lever 56 to a driving mechanism in a common reciprocal movement dictated by a crank shaft 58 rotated by means of a motor gear assembly 59 fixed to the frame 100.

This last embodiment enables increased grinding capacity of the device and greater total speed along the rail 1.

The adjustment of the cutting depth for each stroke of the grinding wheel may be directly and manually realized, without a feed-back loop control by a preestablished displayed value. In this case, the device will comprise a screw and nut connection controlled by a handle, for example in place of the jack 14.

In a construction intended to permit the correction of several categories of deformations spread over the head of rail, the entire mechanism (8 to 13) actuating the grinding wheel 6 and its combined rotary and alternating movements will be connected to the frame 2 through the intermediary of a frame adjustable in a plane transverse to the track. For the same reason, several of these assemblies each comprising a grinding wheel will be mounted on the same frame, each oriented in a different direction appropriate to the deformation to be corrected.

Of course, in the case of the variants shown schematically in FIGS. 9, 10 and 11, the whole of the movable equipment is mounted on the frame through the intermediary of a support movable with respect to the frame 2 (not shown) that enables adjustment of the depth of the cutting stroke of the grinding wheel and to uniformly distribute wear over the working surface of the wheel.

The embodiments of the invention in which the exclusive property or privilege is claimed are defined as follows:

1. Grinding device for the reprofiling in situ and continuously of a rail of a railway track comprising at least one grinding unit comprising at least one peripheral grinding wheel driven in rotation by means of a motor, this device being mounted on a tool carrying frame of a railroad vehicle so that the axis of rotation of the grinding wheel forms an angle with the longitudinal axis of the rail and that said rotation axis has no intersection with the rail itself, means to displace the grinding wheel vertically relative to the vehicle and to apply it against the rail with a determined force, and means automatically bodily moving the grinding wheel in an alternating movement along a direction forming an angle with the rail, the amplitude a of the alternating movement of the grinding wheel, projected into a plane perpendicular to the longitudinal axis of the rail passing through the contact zone between the grinding wheel and the rail, being approximately equal to the projection l in the same plane, of the width of the working face of the grinding wheel diminished by the width f of the ground portion of the rail.

2. Device according to claim 1, in which the bodily moving mechanism of the grinding wheel in alternating movement comprises an eccentric shaft on which a movable support is pivoted which carries the grinding unit.

3. Device according to claim 1, in which the alternating movement of the grinding wheel is rectilinear.

4. Device according to claim 1, in which the alternating movement of the grinding wheel takes place along a curved line.

5. Device according to claim 1, and regulating means for the amplitude of the alternating movement of the grinding wheel.

6. Device according to claim 1, in which the grinding wheel is frustoconical.

7. Device according to claim 1, in which the side line of the grinding wheel is in contact with the rail is inclined with respect to the longitudinal axis of this rail.

* * * * *